US008825475B2

(12) United States Patent
Eksler

(10) Patent No.: US 8,825,475 B2
(45) **Date of Patent: *Sep. 2, 2014**

(54) TRANSFORM-DOMAIN CODEBOOK IN A CELP CODER AND DECODER

(75) Inventor: Vaclav Eksler, Sherbrooke (CA)

(73) Assignee: Voiceage Corporation, Town of Mount Royal, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/469,744

(22) Filed: May 11, 2012

(65) Prior Publication Data

US 2012/0290295 A1 Nov. 15, 2012

Related U.S. Application Data

(60) Provisional application No. 61/484,968, filed on May 11, 2011.

(51) Int. Cl.

| | |
|---|---|
| ***G10L 19/12*** | (2013.01) |
| ***G10L 19/00*** | (2013.01) |
| ***G10L 21/00*** | (2013.01) |
| ***G10L 21/04*** | (2013.01) |

(52) U.S. Cl.

CPC ..... *G10L 19/12* (2013.01)
USPC ..... 704/219; 704/220; 704/222; 704/223; 704/500; 704/501; 704/502; 704/503; 704/504

(58) Field of Classification Search

None
See application file for complete search history.

(56) References Cited

U.S. PATENT DOCUMENTS

| | | | | |
|---|---|---|---|---|
| 6,108,626 | A * | 8/2000 | Cellario et al. | 704/230 |
| 6,134,518 | A * | 10/2000 | Cohen et al. | 704/201 |
| 6,453,289 | B1 * | 9/2002 | Ertem et al. | 704/225 |
| 7,106,228 | B2 | 9/2006 | Bessette et al. | |
| 2003/0009325 | A1 * | 1/2003 | Kirchherr et al. | 704/211 |

(Continued)

FOREIGN PATENT DOCUMENTS

| | | |
|---|---|---|
| WO | 2009/033288 | 3/2009 |
| WO | 2011/048094 | 4/2011 |

OTHER PUBLICATIONS

Bessette et al., "Universal Speech/Audio Coding Using Hybrid ACELP/TCX Techniques", 2005 IEEE International Conference on Speech, Acoustics and Signal Processing, ICASSP '05, vol. 3, Mar. 23, 2005, pp. III/301-III/304.

(Continued)

*Primary Examiner* — Richemond Dorvil
*Assistant Examiner* — Thuykhanh Le
(74) *Attorney, Agent, or Firm* — Fay Kaplun & Marcin, LLP

(57) ABSTRACT

Codebook Arrangement for use in coding an input sound signal includes First and Second Codebook Stages. First Codebook Stage includes one of a time-domain CELP codebook and a transform-domain codebook. Second Codebook Stage follows the first codebook stage and includes the other of the time-domain CELP codebook and the transform-domain codebook. Codebook Stage includes an adaptive codebook may be provided before First Codebook Stage. A selector may be provided to select an order of the time-domain CELP codebook and the transform-domain codebook in First and Second Codebook Stages, respectively, as a function of characteristics of the input sound signal. The selector may also be responsive to both the characteristics of the input sound signal and a bit rate of the codec using Codebook Arrangement to bypass Second Codebook Stage. Codebook Arrangement can be used in a coder of an input sound signal.

32 Claims, 6 Drawing Sheets

(56) References Cited

U.S. PATENT DOCUMENTS

| | | | | |
|---|---|---|---|---|
| 2003/0191635 | A1* | 10/2003 | Minde et al. | 704/220 |
| 2006/0036435 | A1* | 2/2006 | Kovesi et al. | 704/229 |
| 2006/0173677 | A1* | 8/2006 | Sato et al. | 704/223 |
| 2007/0225971 | A1* | 9/2007 | Bessette | 704/203 |
| 2009/0024386 | A1* | 1/2009 | Su et al. | 704/201 |
| 2009/0240491 | A1* | 9/2009 | Reznik | 704/219 |
| 2009/0306992 | A1* | 12/2009 | Ragot et al. | 704/500 |
| 2010/0088089 | A1* | 4/2010 | Hardwick | 704/208 |
| 2010/0241425 | A1* | 9/2010 | Eksler et al. | 704/220 |
| 2011/0010168 | A1* | 1/2011 | Yu et al. | 704/219 |
| 2011/0082693 | A1* | 4/2011 | Krishnan et al. | 704/225 |
| 2011/0224994 | A1* | 9/2011 | Norvell et al. | 704/500 |
| 2012/0089389 | A1 | 4/2012 | Bessette et al. | |
| 2012/0185256 | A1* | 7/2012 | Virette et al. | 704/500 |

OTHER PUBLICATIONS

3GPP TS 26.290 V61.1, 3rd Generation Partnership Project, Technical Specification Group Servicesand System Aspects; Speech Codec Speech Processing Functions; Adaptive Multi-Rate-Wideband (AMR-WB) Speech Codec; Transcoding Functions, Release 6, Jul. 2005, pp. 1-53.

* cited by examiner

TRANSFORM-DOMAIN CODEBOOK IN A CELP CODER AND DECODER

FIELD

The present disclosure relates to a codebook arrangement for use in coding an input sound signal, and a coder using such codebook arrangement.

BACKGROUND

The Code-Excited Linear Prediction (CELP) model is widely used to encode sound signals, for example speech, at low bit rates.

In CELP coding, the speech signal is sampled and processed in successive blocks of a predetermined number of samples usually called frames, each corresponding typically to 10-30 ms of speech. The frames are in turn divided into smaller blocks called sub-frames.

In CELP, the signal is modelled as an excitation processed through a time-varying synthesis filter 1/A(z). The time-varying synthesis filter may take many forms, but very often a linear recursive all-pole filter is used. The inverse of the time-varying synthesis filter, which is thus a linear all-zero non-recursive filter A(z), is defined as a short-term predictor (STP) since it comprises coefficients calculated in such a manner as to minimize a prediction error between a sample s(n) of the input sound signal and a weighted sum of the previous samples s(n−1), s(n−2), . . . , s(n−m), where m is the order of the filter and n is a discrete time domain index, n=0, . . . , L−1, L being the length of an analysis window. Another denomination frequently used for the STP is Linear Predictor (LP).

If the prediction error from the LP filter is applied as the input of the time-varying synthesis filter with proper initial state, the output of the synthesis filter is the original sound signal, for example speech. At low bit rates, it is not possible to transmit the exact error residual (minimized prediction error from the LP filter). Accordingly, the error residual is encoded to form an approximation referred to as the excitation. In CELP coders, the excitation is encoded as the sum of two contributions, the first contribution taken from a so-called adaptive codebook and the second contribution from a so-called innovative or fixed codebook. The adaptive codebook is essentially a block of samples v(n) from the past excitation signal (delayed by a delay parameter t) and scaled with a proper gain $g_p$. The innovative or fixed codebook is populated with vectors having the task of encoding a prediction residual from the STP and adaptive codebook. The innovative or fixed codebook vector c(n) is also scaled with a proper gain $g_c$. The innovative or fixed codebook can be designed using many structures and constraints. However, in modern speech coding systems, the Algebraic Code-Excited Linear Prediction (ACELP) model is used. An example of an ACELP implementation is described in [3GPP TS 26.190 "Adaptive Multi-Rate-Wideband (AMR-WB) speech codec; Transcoding functions"] and, accordingly, ACELP will only be briefly described in the present disclosure. Also, the full content of this reference is herein incorporated by reference.

Although very efficient to encode speech at low bit rates, ACELP codebooks cannot gain in quality as quickly as other approaches (for example transform coding and vector quantization) when increasing the ACELP codebook size. When measured in dB/bit/sample, the gain in quality at higher bit rates (for example bit rates higher than 16 kbits/s) obtained by using more non-zero pulses per track in an ACELP codebook is not as large as the gain in quality (in dB/bit/sample) at higher bit rates obtained with transform coding and vector quantization. This can be seen when considering that ACELP essentially encodes the sound signal as a sum of delayed and scaled impulse responses of the time-varying synthesis filter. At lower bit rates (for example bit rates lower than 12 kbits/s), the ACELP model captures quickly the essential components of the excitation. But at higher bit rates, higher granularity and, in particular, a better control over how the additional bits are spent across the different frequency components of the signal are useful.

DETAILED DESCRIPTION

In accordance with a non-restrictive, illustrative embodiment, there is provided a codebook arrangement for use in coding an input sound signal, comprising:

a first codebook stage including one of a time-domain CELP codebook and a transform-domain codebook; and a second codebook stage following the first codebook stage and including the other of the time-domain CELP codebook and the transform-domain codebook.

According to another non-restrictive, illustrative embodiment, there is provided a coder of an input sound signal, comprising:

a first, adaptive codebook stage structured to search an adaptive codebook to find an adaptive codebook index and an adaptive codebook gain;

a second codebook stage including one of a time-domain CELP codebook and a transform-domain codebook; and a third codebook stage following the second codebook stage and including the other of the time-domain CELP codebook and the transform-domain codebook;

wherein the second and third codebook stages are structured to search the respective time-domain CELP codebook and transform-domain codebook to find an innovative codebook index, an innovative codebook gain, transform-domain coefficients, and a transform-domain codebook gain.

Optionally, there may be provided a selector of an order of the time-domain CELP codebook and the transform-domain codebook in the second and third codebook stages, respectively, as a function of at least one of (a) characteristics of the input sound signal and (b) a bit rate of a codec using the codebook arrangement.

The foregoing and other features of the codebook arrangement and coder will become more apparent upon reading of the following non restrictive description of embodiments thereof, given by way of illustrative examples only with reference to the accompanying drawings.

Figure 1:
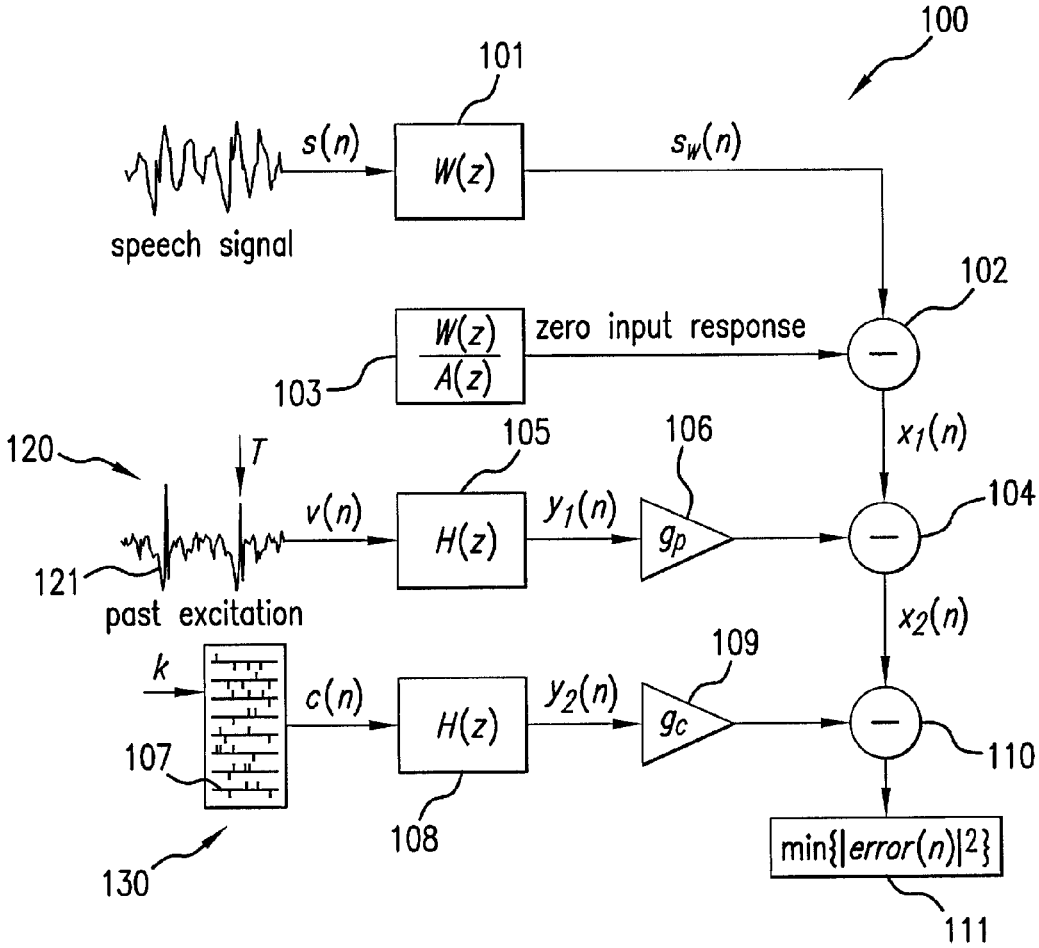
FIG. 1 is a schematic block diagram of an example of CELP coder using, in this non-limitative example, ACELP.

FIG. 1 shows the main components of an ACELP coder 100.

In FIG. 1, $y_1(n)$ is the filtered adaptive codebook excitation signal (i.e. the zero-state response of the weighted synthesis filter to the adaptive codebook vector v(n)), and $y_2(n)$ is similarly the filtered innovative codebook excitation signal. The signals $x_1(n)$ and $x_2(n)$ are target signals for the adaptive and the innovative codebook searches, respectively. The weighted synthesis filter, denoted as H(z), is the cascade of the LP synthesis filter 1/A(z) and a perceptual weighting filter W(z), i.e. H(z)=[1/A(z)]·W(z).

The LP filter A(z) may present, for example, in the z-transform, the transfer function $$A(z) = \sum_{i=0}^{M} a_i z^{-i},$$

where $a_i$ represent the linear prediction coefficients (LP coefficients) with $a_0=1$, and M is the number of linear prediction coefficients (order of LP analysis). The LP coefficients $a_i$ are determined in an LP analyzer (not shown) of the ACELP coder 100. The LP analyzer is described for example in the aforementioned article [3GPP TS 26.190 "Adaptive Multi-Rate-Wideband (AMR-WB) speech codec; Transcoding functions"] and, therefore, will not be further described in the present disclosure.

An example of perceptual weighting filter can be $W(z)=A(z/\gamma_1)/A(z/\gamma_2)$ where $\gamma_1$ and $\gamma_2$ are constants having a value between 0 and 1 and determining the frequency response of the perceptual weighting filter W(z).

Adaptive Codebook Search

In the ACELP coder 100 of FIG. 1, an adaptive codebook search is performed in the adaptive codebook stage 120 during each sub-frame by minimizing the mean-squared weighted error between the original and synthesized speech. This is achieved by maximizing the term $$\mathfrak{I}_t = \frac{\left(\sum_{n=0}^{N-1} x_1(n) y_1(n)\right)^2}{\sum_{n=0}^{N-1} y_1(n) y_1(n)}, \tag{1}$$

where $x_1(n)$ is the above mentioned target signal, $y_1(n)$ is the above mentioned filtered adaptive codebook excitation signal, and N is the length of a sub-frame.

Target signal $x_1(n)$ is obtained by first processing the input sound signal s(n), for example speech, through the perceptual weighting filter W(z) 101 to obtain a perceptually weighted input sound signal $s_w(n)$. A subtractor 102 then subtracts the zero-input response of the weighted synthesis filter H(z) 103 from the perceptually weighted input sound signal $s_w(n)$ to obtain the target signal $x_1(n)$ for the adaptive codebook search. The perceptual weighting filter W(z) 101, the weighted synthesis filter H(z)=W(z)/A(z) 103, and the subtractor 102 may be collectively defined as a calculator of the target signal $x_1(n)$ for the adaptive codebook search.

An adaptive codebook index T (pitch delay) is found during the adaptive codebook search. Then the adaptive codebook gain $g_p$ (pitch gain), for the adaptive codebook index T found during the adaptive codebook search, is given by $$g_p = \frac{\sum_{n=0}^{N-1} x_1(n) y_1^{(T)}(n)}{\sum_{n=0}^{N-1} y_1(n) y_1^{(T)}(n)}. \tag{2}$$

For simplicity, the codebook index T is dropped from the notation of the filtered adaptive codebook excitation signal. Thus signal $y_1(n)$ is equivalent to the signal $y_1^{(T)}(n)$.

The adaptive codebook index T and adaptive codebook gain $g_p$ are quantized and transmitted to the decoder as adaptive codebook parameters. The adaptive codebook search is described in the aforementioned article [3GPP TS 26.190 "Adaptive Multi-Rate-Wideband (AMR-WB) speech codec; Transcoding functions"] and, therefore, will not be further described in the present disclosure.

Innovative Codebook Search

An innovative codebook search is performed in the innovative codebook stage 130 by minimizing, in the calculator 111, the mean square weighted error after removing the adaptive codebook contribution, i.e.

$$E = \min_k \left\{ \sum_{n=0}^{N-1} [x_2(n) - g_c \cdot y_2^{(k)}(n)]^2 \right\}, \tag{3}$$

where the target signal $x_2(n)$ for the innovative codebook search is computed by subtracting, through a subtractor 104, the adaptive codebook excitation contribution $g_p \cdot y_1(n)$ from the adaptive codebook target signal $x_1(n)$.

$$x_2(n) = x_1(n) - g_p \cdot y_1(n). \tag{4}$$

The adaptive codebook excitation contribution is calculated in the adaptive codebook stage 120 by processing the adaptive codebook vector v(n) at the adaptive codebook index T from an adaptive codebook 121 (time-domain CELP codebook) through the weighted synthesis filter H(z) 105 to obtain the filtered adaptive codebook excitation signal $y_1(n)$ (i.e. the zero-state response of the weighted synthesis filter 105 to the adaptive codebook vector v(n)), and by amplifying the filtered adaptive codebook excitation signal $y_1(n)$ by the adaptive codebook gain $g_p$ using amplifier 106.

The innovative codebook excitation contribution $g_c \cdot y_2^{(k)}(n)$ of Equation (3) is calculated in the innovative codebook stage 130 by applying an innovative codebook index k to an innovative codebook 107 to produce an innovative codebook vector c(n). The innovative codebook vector c(n) is then processed through the weighted synthesis filter H(z) 108 to produce the filtered innovative codebook excitation signal $y_2^{(k)}(n)$. The filtered innovative codebook excitation signal $y_2^{(k)}(n)$ is then amplified, by means of an amplifier 109, with innovation codebook gain $g_c$ to produce the innovative codebook excitation contribution $g_c \cdot y_2^{(k)}(n)$ of Equation (3). Finally, a subtractor 110 calculate the term $x_2(n) - g_c \cdot y_2^{(k)}(n)$. The calculator 111 then squares the latter term and sums this term with other corresponding terms $x_2(n) - g_c \cdot y_2^{(k)}(n)$ at different values of n in the range from 0 to N−1. As indicated in Equation (3), the calculator 11 repeats these operations for different innovative codebook indexes k to find a minimum value of the mean square weighted error E at a given innovative codebook index k, and therefore complete calculation of Equation (3). The innovative codebook index k corresponding to the minimum value of the mean square weighted error E is chosen.

In ACELP codebooks, the innovative codebook vector c(n) contains M pulses with signs $s_j$ and positions $m_j$, and is thus given by $$c(n) = \sum_{j=0}^{M-1} s_j \delta(n - m_j), \tag{5}$$

where $s_j = \pm 1$, and $\delta(n)=1$ for $n=0$, and $\delta(n)=0$ for $n \neq 0$.

Finally, minimizing E from Equation (3) results in the optimum innovative codebook gain $$g_c = \frac{\sum_{n=0}^{N-1} x_2(n) y_2(n)}{\sum_{n=0}^{N-1} (y_2(n))^2}. \tag{6}$$

The innovative codebook index k corresponding to the minimum value of the mean square weighted error E and the corresponding innovative codebook gain $g_c$ are quantized and transmitted to the decoder as innovative codebook parameters. The innovative codebook search is described in the aforementioned article [3GPP TS 26.190 "Adaptive Multi-Rate-Wideband (AMR-WB) speech codec; Transcoding functions"] and, therefore, will not be further described in the present specification.

Figure 2:
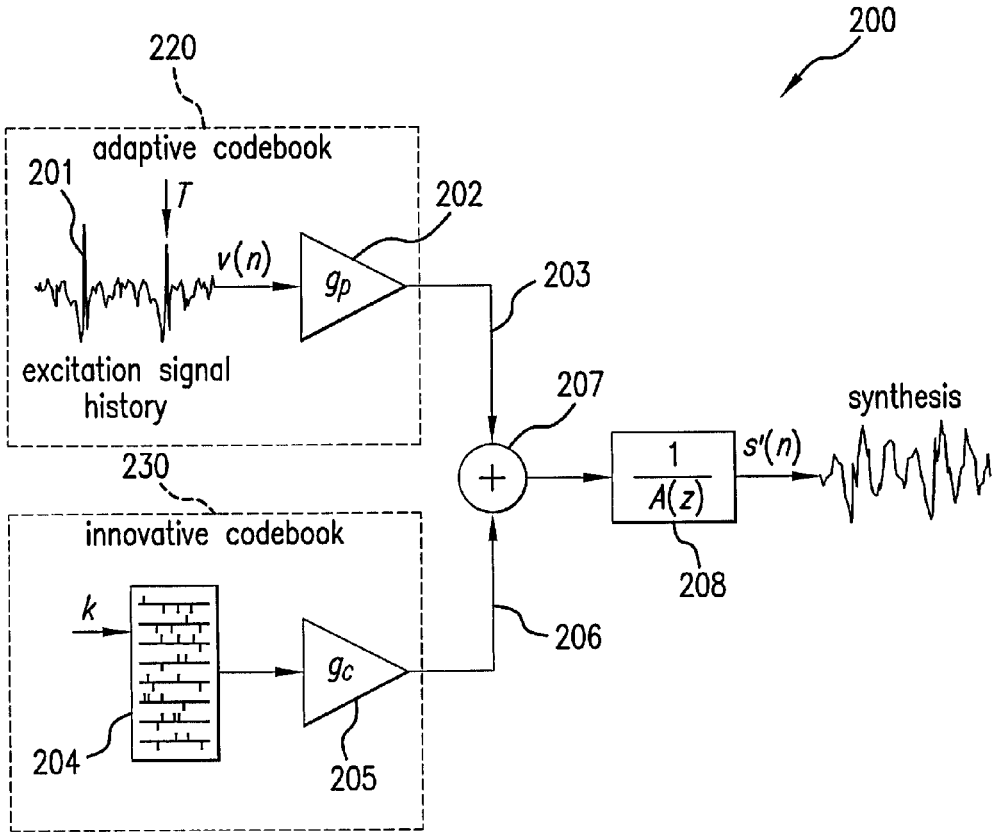
FIG. 2 is a schematic block diagram of an example of CELP decoder using, in this non-limitative example, ACELP.

FIG. 2 is a schematic block diagram showing the main components and the principle of operation of an ACELP decoder 200.

Referring to FIG. 2, the ACELP decoder 200 receives decoded adaptive codebook parameters including the adaptive codebook index T (pitch delay) and the adaptive codebook gain $g_p$ (pitch gain). In an adaptive codebook stage 220, the adaptive codebook index T is applied to an adaptive codebook 201 to produce an adaptive codebook vector v(n) amplified with the adaptive codebook gain $g_p$ in an amplifier 202 to produce an adaptive codebook excitation contribution 203.

Still referring to FIG. 2, the ACELP decoder 200 also receives decoded innovative codebook parameters including the innovative codebook index k and the innovative codebook gain $g_c$. In an innovative codebook stage 230, the decoded innovative codebook index k is applied to an innovative codebook 204 to output a corresponding innovative codebook vector. The vector from the innovative codebook 204 is then amplified with the innovative codebook gain $g_c$ in amplifier 205 to produce an innovative codebook excitation contribution 206.

The total excitation is then formed through summation in an adder 207 of the adaptive codebook excitation contribution 203 and the innovative codebook excitation contribution 206. The total excitation is then processed through a LP synthesis filter 1/A(z) 208 to produce a synthesis s'(n) of the original sound signal s(n), for example speech.

The present disclosure teaches to modify the CELP model such that another additional codebook stage is used to form the excitation. Such another codebook is further referred to as a transform-domain codebook stage as it encodes transform-domain coefficients. The choice of a number of codebooks and their order in the CELP model are described in the following description. A general structure of a modified CELP model is further shown in FIG. 6.

First Structure of Modified CELP Model

Figure 4:
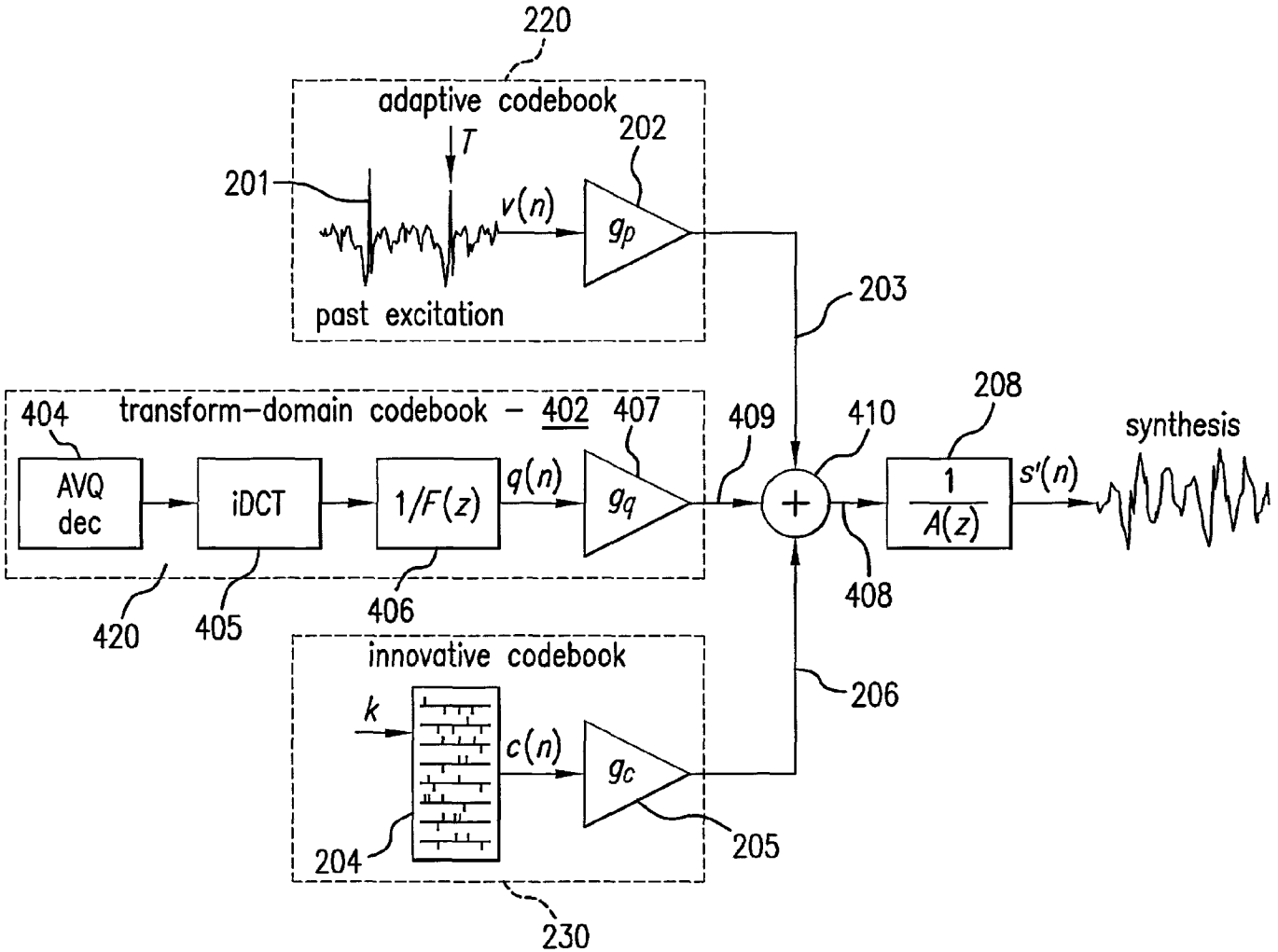
FIG. 4 is a schematic block diagram of a CELP decoder in accordance with the first structure of modified CELP model.

FIG. 4 is a schematic block diagram showing the first structure of modified CELP model applied to a decoder using, in this non-limitative example, an ACELP decoder. The first structure of modified CELP model comprises a first codebook arrangement including an adaptive codebook stage 220, a transform-domain codebook stage 420, and an innovative codebook stage 230. As illustrated in FIG. 4, the total excitation e(n) 408 comprises the following contributions:

- In the adaptive codebook stage 220, an adaptive codebook vector v(n) is produced by the adaptive codebook 201 in response to an adaptive codebook index T and scaled by the amplifier 202 using adaptive codebook gain $g_p$ to produce an adaptive codebook excitation contribution 203;
- In the transform-domain codebook stage 420, a transform-domain vector q(n) is produced and scaled by an amplifier 407 using a transform-domain codebook gain $g_q$ to produce a transform-domain codebook excitation contribution 409; and
- In the innovative codebook stage 230, an innovative codebook vector c(n) is produced by the innovative codebook 204 in response to an innovative codebook index k and scaled by the amplifier 205 using innovation codebook gain $g_c$ to produce an innovative codebook excitation contribution 409. This is illustrated by the following relation:

$$e(n)=g_p \cdot v(n)+g_q \cdot q(n)+g_c \cdot c(n),\ n=0, \ldots, N-1, \tag{7}$$

This first structure of modified CELP model combines a transform-domain codebook 402 in one stage 420 followed by a time-domain ACELP codebook or innovation codebook 204 in a following stage 230. The transform-domain codebook 402 may use, for example, a Discrete Cosine Transform (DCT) as the frequency representation of the sound signal and an Algebraic Vector Quantizer (AVQ) decoder to de-quantize the transform-domain coefficients of the DCT. It should be noted that the use of DCT and AVQ are examples only; other transforms can be implemented and other methods to quantize the transform-domain coefficients can also be used.

Computation of the Target Signal for the Transform-Domain Codebook

At the coder (FIG. 3), the transform-domain codebook of the transform-domain codebook stage 320 of the first codebook arrangement operates as follows. In a given sub-frame (aligned with the sub-frame of the innovative codebook) the target signal for the transform-domain codebook $q_{in}(n)$ 300, i.e. the excitation residual r(n) after removing the scaled adaptive codebook vector $g_p \cdot v(n)$, is computed as $$q_{in}(n)=r(n)-g_p \cdot v(n),\ n=0, \ldots, N-1, \tag{8}$$

where r(n) is the so-called target vector in residual domain obtained by filtering the target signal $x_1(n)$ 315 through the inverse of the weighted synthesis filter H(z) with zero states. The term v(n) 313 represents the adaptive codebook vector and $g_p$ 314 the adaptive codebook gain.

Pre-Emphasis Filtering

In the transform-domain codebook, the target signal for the transform-domain codebook $q_{in}(n)$ 300 is pre-emphasized with a filter F(z) 301. An example of a pre-emphasis filter is $F(z)=1/(1-\alpha \cdot z^{-1})$ with a difference equation given by $$q_{in,d}(n)=q_{in}(n)+\alpha \cdot q_{in,d}(n-1), \tag{9}$$

where $q_{in}(n)$ 300 is the target signal inputted to the pre-emphasis filter F(z) 301, $q_{in,d}(n)$ 302 is the pre-emphasized target signal for the transform-domain codebook and coefficient $\alpha$ controls the level of pre-emphasis. In this non-limitative example, if the value of $\alpha$ is set between 0 and 1, the pre-emphasis filter applies a spectral tilt to the target signal for the transform-domain codebook to enhance the lower frequencies.

Transform Calculation

The transform-domain codebook also comprises a transform calculator 303 for applying, for example, a DCT to the pre-emphasized target signal $q_{in,d}(n)$ 302 using, for example, a rectangular non-overlapping window to produce blocks of transform-domain DCT coefficients $Q_{in,d}(k)$ 304. The DCT-II can be used, the DCT-II being defined as $$Q_{in,d}(k) = \sum_{n=0}^{N-1} q_{in,d}(n)\cos\left[\frac{\pi}{N}\left(n+\frac{1}{2}\right)k\right], \tag{10}$$

where k=0, . . . , N−1, N being the sub-frame length.

Quantization

Depending on the bit-rate, the transform-domain codebook quantizes all blocks or only some blocks of transform-domain DCT coefficients $Q_{in,d}(k)$ 304 usually corresponding to lower frequencies using, for example, an AVQ encoder 305 to produce quantized transform-domain DCT coefficients $Q_d(k)$ 306. The other, non quantized transform-domain DCT coefficients $Q_{in,d}(k)$ 304 are set to 0 (not quantized). An example of AVQ implementation can be found in U.S. Pat. No. 7,106,228 of which the content is herein incorporated by reference. The indices of the quantized and coded transform-domain coefficients 306 from the AVQ encoder 305 are transmitted as transform-domain codebook parameters to the decoder.

In every sub-frame, a bit-budget allocated to the AVQ is composed as a sum of a fixed bit-budget and a floating number of bits. The AVQ encoder 305 comprises a plurality of AVQ sub-quantizers for AVQ quantizing the transform-domain DCT coefficients $Q_{in,d}(k)$ 304. Depending on the used AVQ sub-quantizers of the encoder 305, the AVQ usually does not consume all of the allocated bits, leaving a variable number of bits available in each sub-frame. These bits are floating bits employed in the following sub-frame. The floating number of bits is equal to 0 in the first sub-frame and the floating bits resulting from the AVQ in the last sub-frame in a given frame remain unused. The previous description of the present paragraph stands for fixed bit rate coding with a fixed number of bits per frame. In a variable bit rate coding configuration, different number of bits can be used in each sub-frame in accordance with a certain distortion measure or in relation to the gain of the AVQ encoder 305. The number of bits can be controlled to attain a certain average bit rate.

Inverse Transform Calculation

To obtain the transform-domain codebook excitation contribution in the time domain, the transform-domain codebook stage 320 first inverse transforms the quantized transform-domain DCT coefficients $Q_d(k)$ 306 in an inverse transform calculator 307 using an inverse DCT (iDCT) to produce an inverse transformed, emphasized quantized excitation (inverse-transformed sound signal) $q_d(n)$ 308. The inverse DCT-II (corresponding to DCT-III up to a scale factor 2/N) is used, and is defined as $$q_d(n) = \frac{2}{N}\left\{\frac{1}{2}Q_d(0) + \sum_{k=1}^{N-1} Q_d(k)\cos\left[\frac{\pi}{N}k\left(n+\frac{1}{2}\right)\right]\right\}, \tag{11}$$

where n=0, . . . , N−1, N being the sub-frame length.

De-Emphasis Filtering

Then a de-emphasis filter 1/F(z) 309 is applied to the inverse transformed, emphasized quantized excitation $q_d(n)$ 308 to obtain the time-domain excitation from the transform-domain codebook stage q(n) 310. The de-emphasis filter 309 has the inverse transfer function (1/F(z)) of the pre-emphasis filter F(z) 301. In the non-limitative example for pre-emphasis filter F(z) given above in Equation (9), the difference equation of the de-emphasis filter 1/F(z) would be given by $$q(n)=q_d(n)-\alpha\cdot q_d(n-1), \tag{12}$$

where, in the case of the de-emphasis filter 309, $q_d(n)$ 308 is the inverse transformed, emphasized quantized excitation $q_d(n)$ 308 and q(n) 310 is the time-domain excitation signal from the transform-domain codebook stage q(n).

Transform-Domain Codebook Gain Calculation and Quantization

Once the time-domain excitation signal from the transform-domain codebook stage q(n) 310 is computed, a calculator (not shown) computes the transform-domain codebook gain as follows:

$$g_q = \frac{\sum_{k=0}^{N-1} Q_{in,d}(k)Q_d(k)}{\sum_{k=0}^{N-1} Q_d(k)Q_d(k)}, \tag{13}$$

where $Q_{in,d}(k)$ are the AVQ input transform-domain DCT coefficients 304, $Q_d(k)$ are the AVQ output (quantized) transform-domain DCT coefficients 304, k is the transform-domain coefficient index, k=0, . . . , N−1, N being the number of transform-domain DCT coefficients.

Still in the transform-domain codebook stage 320, the transform-domain codebook gain from Equation (13) is quantized as follows. First, the gain is normalized by the predicted innovation energy $E_{pred}$ as follows:

$$g_{q,norm} = \frac{g_q}{E_{pred}}. \tag{14}$$

The predicted innovation energy $E_{pred}$ is obtained as an average residual signal energy over all sub-frames within the given frame, with subtracting an estimate of the adaptive codebook contribution. That is $$E_{pred} = \frac{1}{P}\sum_{i=0}^{P-1}\left[10\log\left(\frac{1}{N}\sum_{n=0}^{N-1} r^2(n)\right)\right] - 0.5(C_{norm}(0) + C_{norm}(1)),$$

where P is the number of sub-frames, and $C_{norm}(0)$ and $C_{norm}(1)$ the normalized correlations of the first and the second half-frames of the open-loop pitch analysis, respectively, and r(n) is the target vector in residual domain.

Then the normalized gain $g_{q,norm}$ is quantized by a scalar quantizer in a logarithmic domain and finally de-normalized resulting in a quantized transform-domain codebook gain. In an illustrative example, a 6-bit scalar quantizer is used whereby the quantization levels are uniformly distributed in the log domain. The index of the quantized transform-domain codebook gain is transmitted as a transform-domain codebook parameter to the decoder.

Refinement of the Adaptive Codebook Gain

When the first structure of modified CELP model is used, the time-domain excitation signal from the transform-domain codebook stage q(n) 310 can be used to refine the original target signal for the adaptive codebook search $x_1(n)$ 315 as $$x_{1,updt}(n)=x_1(n)-g_q \cdot y_3(n), \tag{15}$$

and the adaptive codebook stage refines the adaptive codebook gain using Equation (2) with $x_{1,updt}(n)$ used instead of $x_1(n)$. The signal $y_3(n)$ is the filtered transform-domain codebook excitation signal obtained by filtering the time-domain excitation signal from the transform-domain codebook stage q(n) 310 through the weighted synthesis filter H(z) 311 (i.e. the zero-state response of the weighted synthesis filter H(z) 311 to the transform-domain codebook excitation contribution q(n)).

Computation of the Target Vector for Innovative Codebook Search

When the transform-domain codebook stage 320 is used, computation of the target signal for innovative codebook search $x_2(n)$ 316 is performed using Equation (4) with $x_1(n)=x_{1,updt}(n)$ and with $g_p=g_{p,updt}$, i.e., $$\begin{aligned} x_2(n) &= x_{1,updt}(n) - g_{p,updt} \cdot y_1(n) \\ &= x_1(n) - g_q \cdot y_3(n) - g_{p,updt} \cdot y_1(n) \end{aligned} \tag{16}$$

Figure 3:
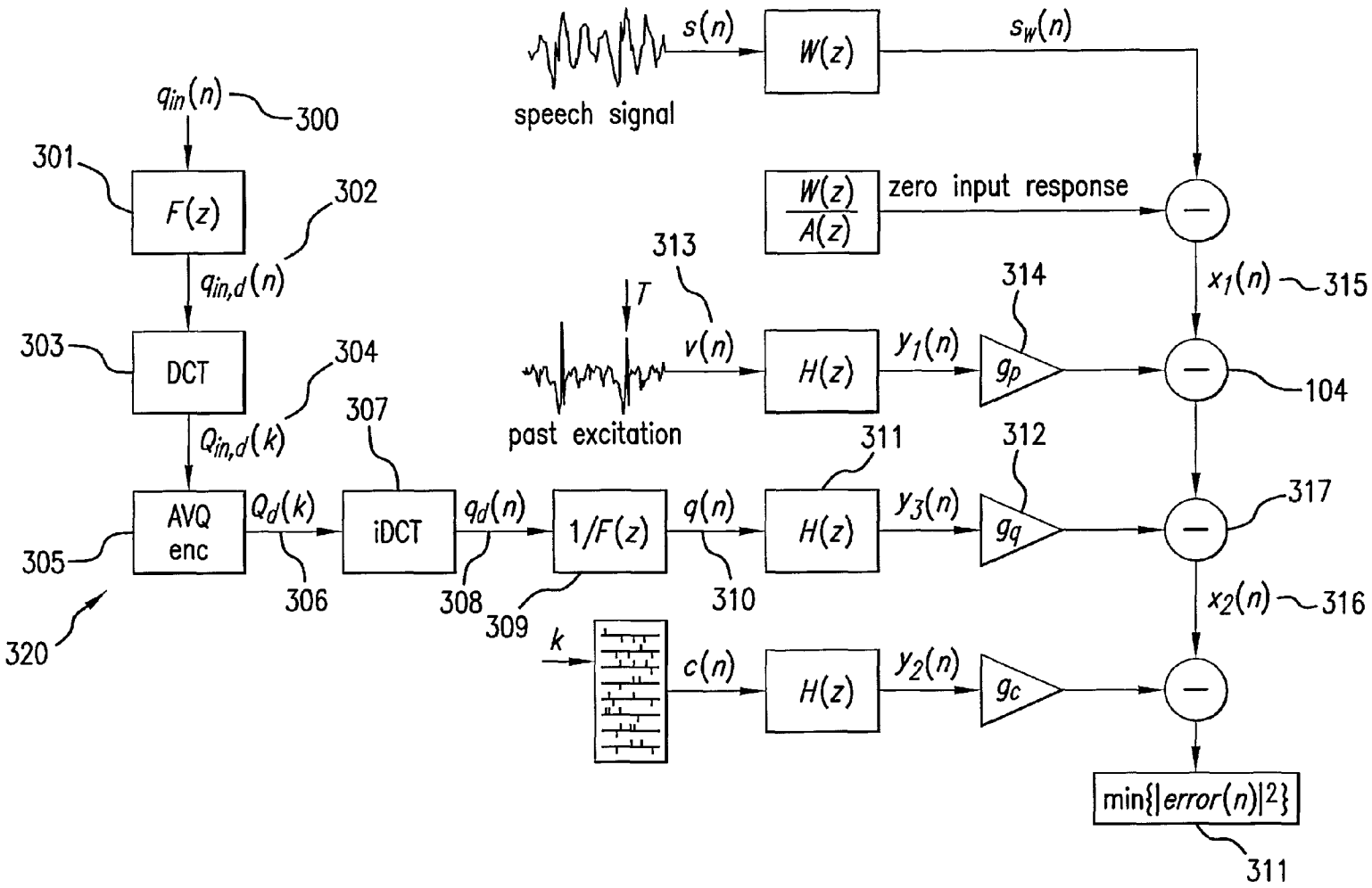
FIG. 3 is a schematic block diagram of a CELP coder using a first structure of modified CELP model, and including a first codebook arrangement.

Referring to FIG. 3, amplifier 312 performs the operation $g_q \cdot y_3(n)$ to calculate the transform-domain codebook excitation contribution, and subtractors 104 and 317 perform the operation $x_1(n)-g_{p,updt} \cdot y_1(n)-g_q \cdot y_3(n)$.

Similarly, the target signal in residual domain r(n) is updated for the innovative codebook search as follows:

$$r_{updt}(n)=r(n)-g_q \cdot q(n)-g_{p,updt} \cdot v(n). \tag{17}$$

The innovative codebook search is then applied as in the ACELP model.

Transform-Domain Codebook in the Decoder

Referring back to FIG. 4, at the decoder, the excitation contribution 409 from the transform-domain codebook stage 420 is obtained from the received transform-domain codebook parameters including the quantized transform-domain DCT coefficients $Q_d(k)$ and the transform-domain codebook gain $g_q$.

The transform-domain codebook first de-quantizes the received, decoded (quantized) quantized transform-domain DCT coefficients $Q_d(k)$ using, for example, an AVQ decoder 404 to produce de-quantized transform-domain DCT coefficients. An inverse transform, for example inverse DCT (iDCT), is applied to these de-quantized transform-domain DCT coefficients through an inverse transform calculator 405. At the decoder, the transform-domain codebook applies a de-emphasis filter 1/F(z) 406 after the inverse DCT transform to form the time-domain excitation signal q(n) 407. The transform-domain codebook stage 420 then scales, by means of an amplifier 407 using the transform-domain codebook gain $g_q$, the time-domain excitation signal q(n) 407 to form the transform-domain codebook excitation contribution 409.

The total excitation 408 is then formed through summation in an adder 410 of the adaptive codebook excitation contribution 203, the transform-domain codebook excitation contribution 409, and the innovative codebook excitation contribution 206. The total excitation 408 is then processed through the LP synthesis filter 1/A(z) 208 to produce a synthesis s'(n) of the original sound signal, for example speech.

Transform-Domain Codebook Bit-Budget

Usually the higher the bit-rate, the more bits are used by the transform-domain codebook leaving the size of the innovative codebook the same across the different bit-rates. The above disclosed first structure of modified CELP model can be used at high bit rates (around 48 kbit/s and higher) to encode speech signals practically transparently and to efficiently encode generic audio signals as well.

At such high bit rates the vector quantizer of the adaptive and innovative codebook gains may be replaced by two scalar quantizers. More specifically, a linear scalar quantizer is used to quantize the adaptive codebook gain $g_p$ and a logarithmic scalar quantizer is used to quantize the innovative codebook gain $g_c$.

Second Structure of Modified CELP Model

The above described first structure of modified CELP model using a transform-domain codebook stage followed by an innovative codebook stage (FIG. 3) can be further adaptively changed depending on the characteristics of the input sound signal. For example, in coding of inactive speech segments, it may be advantageous to change the order of the transform-domain codebook stage and the ACELP innovative codebook stage. Therefore, the second structure of modified CELP model uses a second codebook arrangement combining the time-domain adaptive codebook in a first codebook stage followed by a time-domain ACELP innovative codebook in a second codebook stage followed by a transform-domain codebook in a third codebook stage. The ACELP innovative codebook of the second stage usually may comprise very small codebooks and may even be avoided.

Contrary to the first structure of modified CELP model where the transform-domain codebook stage can be seen as a pre-quantizer for the innovative codebook stage, the transform-domain codebook stage in the second codebook arrangement of the second structure of modified CELP model is used as a stand-alone third-stage quantizer (or a second-stage quantizer if the innovative codebook stage is not used). Although the transform-domain codebook stage puts usually more weights in coding the perceptually more important lower frequencies, contrary to the transform-domain codebook stage in the first codebook arrangement to whiten the excitation residual after subtraction of the adaptive and innovative codebook excitation contributions in all the frequency range. This can be desirable in coding the noise-like (inactive) segments of the input sound signal.

Computation of the Target Signal for the Transform-Domain Codebook

Figure 5:
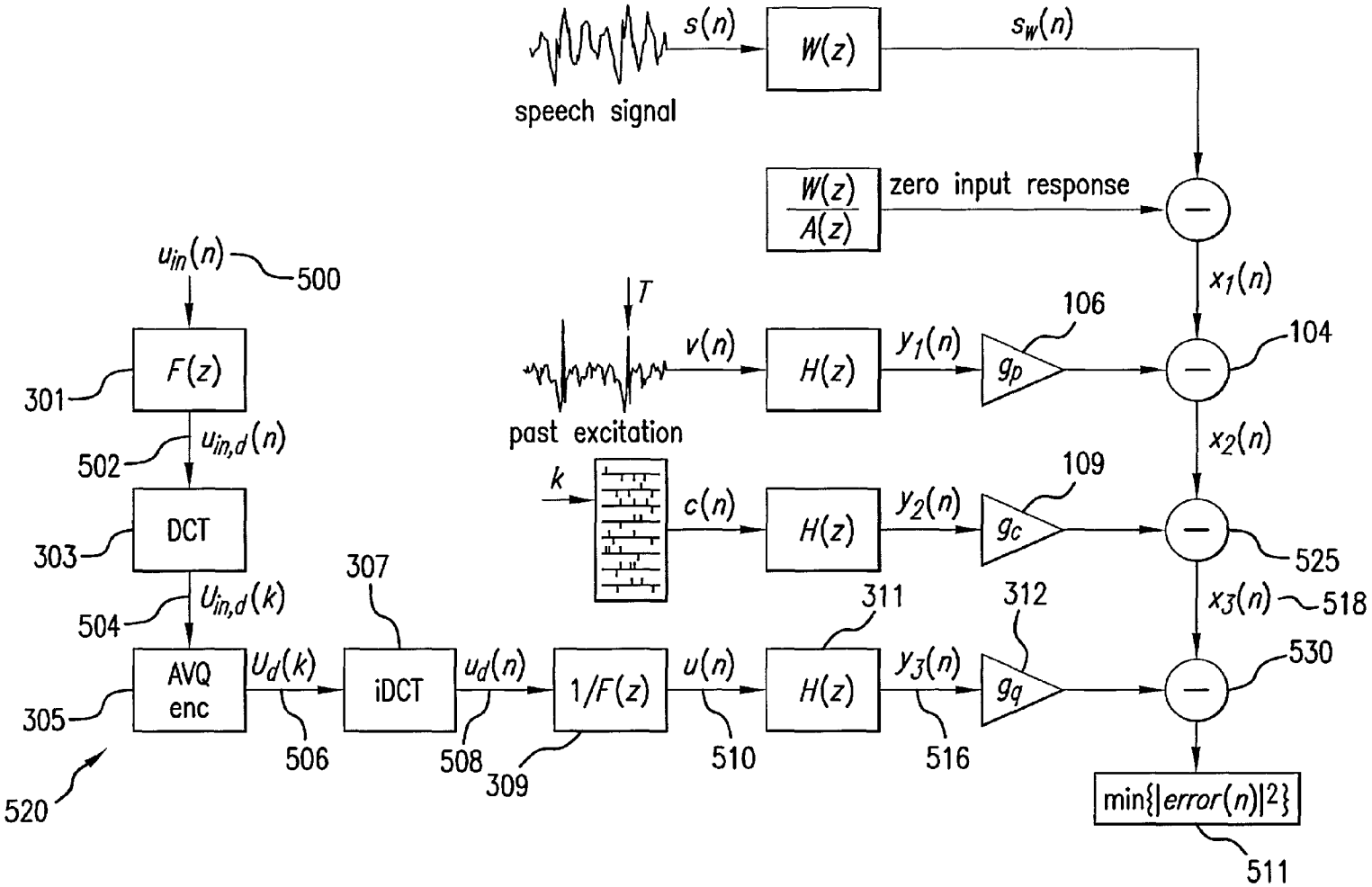
FIG. 5 is a schematic block diagram of a CELP coder using a second structure of modified CELP model, including a second codebook arrangement.

Referring to FIG. 5, which is a block diagram of the second structure of modified CELP model, the transform-domain codebook stage 520 operates as follows. In a given sub-frame, the target signal for the transform-domain codebook search $x_3(n)$ 518 is computed by a calculator using the subtractor 104 subtracting from the adaptive codebook search target signal $x_1(n)$ the filtered adaptive codebook excitation signal $y_1(n)$ scaled by the amplifier 106 using adaptive codebook gain $g_p$ to form the innovative codebook search target signal $x_2(n)$, and a subtractor 525 subtracting from the innovative codebook search target signal $x_2(n)$ the filtered innovative codebook excitation signal $y_2(n)$ scaled by the amplifier 109 using innovative codebook gain $g_c$ (if the innovative codebook is used), as follows:

$$x_3(n)=x_1(n)-g_p \cdot y_1(n)-g_c \cdot y_2(n) \quad n=0, \ldots, N-1. \tag{18}$$

The calculator also filters the target signal for the transform-domain codebook search $x_3(n)$ 518 through the inverse of the weighted synthesis filter H(z) with zero states resulting in the residual domain target signal for the transform-domain codebook search $u_{in}(n)$ 500.

Pre-Emphasis Filtering

The signal $u_{in}(n)$ 500 is used as the input signal to the transform-domain codebook search. In this non-limitative example, in the transform-domain codebook, the signal $u_{in}(n)$ 500 is first pre-emphasized with filter F(z) 301 to produce pre-emphasized signal $u_{in,d}(n)$ 502. An example of such a pre-emphasis filter is given by Equation (9). The filter of Equation (9) applies a spectral tilt to the signal $u_{in}(n)$ 500 to enhance the lower frequencies.

Transform Calculation

The transform-domain codebook also comprises, for example, a DCT applied by the transform calculator 303 to the pre-emphasized signal $u_{in,d}(n)$ 502 using, for example, a rectangular non-overlapping window to produce blocks of transform-domain DCT coefficients $U_{in,d}(k)$ 504. An example of the DCT is given in Equation (10).

Quantization

Usually all blocks of transform-domain DCT coefficients $U_{in,d}(k)$ 504 are quantized using, for example, the AVQ encoder 305 to produce quantized transform-domain DCT coefficients $U_d(k)$ 506. The quantized transform-domain DCT coefficients $U_d(k)$ 506 can be however set to zero at low bit rates as explained in the foregoing description. Contrary to the transform-domain codebook of the first codebook arrangement, the AVQ encoder 305 may be used to encode blocks with the highest energy across all the bandwidth instead of forcing the AVQ to encode the blocks corresponding to lower frequencies.

Similarly to the first codebook arrangement, a bit-budget allocated to the AVQ in every sub-frame is composed as a sum of a fixed bit-budget and a floating number of bits. The indices of the coded, quantized transform-domain DCT coefficients $U_d(k)$ 506 from the AVQ encoder 305 are transmitted as transform-domain codebook parameters to the decoder.

In another non-limitative example, the quantization can be performed by minimizing the mean square error in a perceptually weighted domain as in the CELP codebook search. The pre-emphasis filter F(z) 301 described above can be seen as a simple form of perceptual weighting. More elaborate perceptual weighting can be performed by filtering the signal $u_{in}(n)$ 500 prior to transform and quantization. For example, replacing the pre-emphasis filter F(z) 301 by the weighted synthesis filter W(z)/A(z) is equivalent to transforming and quantizing the target signal $x_3(n)$. The perceptual weighting can be also applied in the transform domain, e.g. by multiplying the transform-domain DCT coefficients $U_{in,d}(k)$ 504 by a frequency mask prior to quantization. This will eliminate the need of pre-emphasis and de-emphasis filtering. The frequency mask could be derived from the weighted synthesis filter W(z)/A(z).

Inverse Transform Calculation

The quantized transform-domain DCT coefficients $U_d(k)$ 506 are inverse transformed in inverse transform calculator 307 using, for example, an inverse DCT (iDCT) to produce an inverse transformed, emphasized quantized excitation $u_d(n)$ 508. An example of the inverse transform is given in Equation (11).

De-Emphasis Filtering

The inverse transformed, emphasized quantized excitation $u_d(n)$ 508 is processed through the de-emphasis filter 1/F(z) 309 to obtain a time-domain excitation signal from the transform-domain codebook stage u(n) 510. The de-emphasis filter 309 has the inverse transfer function of the pre-emphasis filter F(z) 301; in the non-limitative example for pre-emphasis filter F(z) described above, the transfer function of the de-emphasis filter 309 is given by Equation (12).

The signal $y_3(n)$ 516 is the transform-domain codebook excitation signal obtained by filtering the time-domain excitation signal u(n) 510 through the weighted synthesis filter H(z) 311 (i.e. the zero-state response of the weighted synthesis filter H(z) 311 to the time-domain excitation signal u(n) 510).

Finally, the transform-domain codebook excitation signal $y_3(n)$ 516 is scaled by the amplifier 312 using transform-domain codebook gain $g_q$.

Transform-Domain Codebook Gain Calculation and Quantization

Once the transform-domain codebook excitation contribution u(n) 510 is computed, the transform-domain codebook gain $g_q$ is obtained using the following relation:

$$g_q = \frac{\sum_{k=0}^{N-1} U_{in,d}(k)U_d(k)}{\sum_{k=0}^{N-1} U_d(k)U_d(k)}, \tag{19}$$

where $U_{in,d}(k)$ 504 the AVQ input transform-domain DCT coefficients and $U_d(k)$ 506 are the AVQ output quantized transform-domain DCT coefficients.

The transform-domain codebook gain $g_q$ is quantized using the normalization by the innovative codebook gain $g_c$. In one example, a 6-bit scalar quantizer is used whereby the quantization levels are uniformly distributed in the linear domain. The index of the quantized transform-domain codebook gain $g_q$ is transmitted as transform-domain codebook parameter to the decoder.

Limitation of the Adaptive Codebook Contribution

When coding the inactive sound signal segments, for example inactive speech segments, the adaptive codebook excitation contribution is limited to avoid a strong periodicity in the synthesis. In practice, the adaptive codebook gain $g_p$ is usually constrained by $0 \le g_p \le 1.2$. When coding an inactive sound signal segment, a limiter is provided in the adaptive codebook search to constrain the adaptive codebook gain $g_p$ by $0 \le g_p \le 0.65$.

Transform-Domain Codebook in the Decoder

At the decoder, the excitation contribution from the transform-domain codebook is obtained by first de-quantizing the decoded (quantized) transform-domain (DCT) coefficients (using, for example, an AVQ decoder (not shown)) and applying the inverse transform (for example inverse DCT (iDCT)) to these de-quantized transform-domain (DCT) coefficients. Finally, the de-emphasis filter 1/F(z) is applied after the inverse DCT transform to form the time-domain excitation signal u(n) scaled by the transform-domain codebook gain $g_q$ (see transform-domain codebook 402 of FIG. 4).

At the decoder, the order of codebooks and corresponding codebook stages during the decoding process is not important as a particular codebook contribution does not depend on or affect other codebook contributions. Thus the second codebook arrangement in the second structure of modified CELP model can be identical to the first codebook arrangement of the first structure of modified CELP model of FIG. 4 with q(n)=u(n) and the total excitation is given by Equation (7).

Finally, the transform-domain codebook is searched by subtracting through a subtractor 530 (a) the time-domain excitation signal from the transform-domain codebook stage u(n) processed through the weighted synthesis filter H(z) 311 and scaled by transform-domain codebook gain $g_q$ from (b) the transform-domain codebook search target signal $x_3(n)$ 518, and minimizing error criterion min $\{|error(n)|^2\}$ in calculator 511, as illustrated in FIG. 5.

General Modified CELP Model

Figure 6:
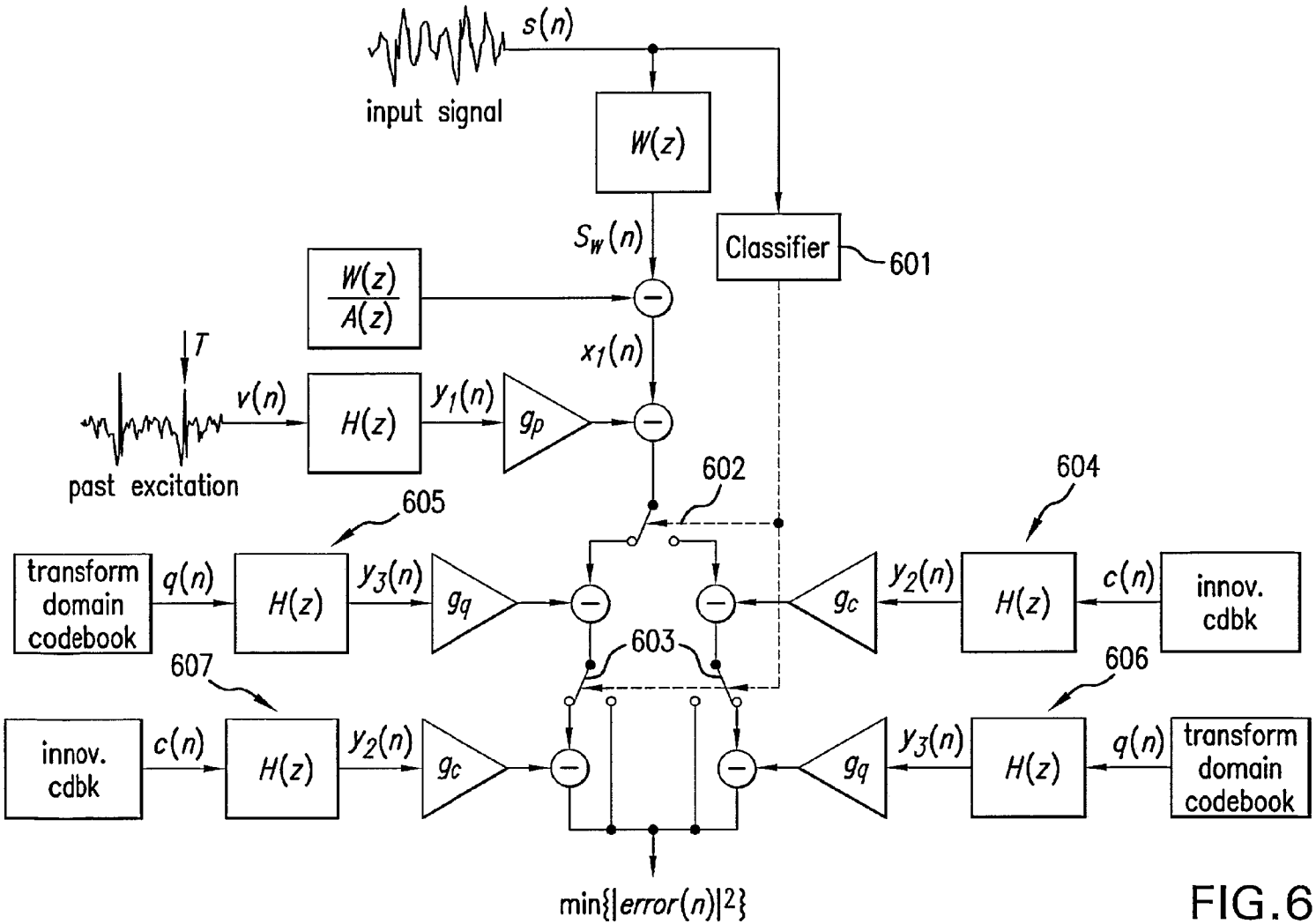
FIG. 6 is a schematic block diagram of an example of general, modified CELP coder with a classifier for choosing between different codebook structures.

A general modified CELP coder with a plurality of possible structures is shown in FIG. 6.

The CELP coder of FIG. 6 comprises a selector of an order of the time-domain CELP codebook and the transform-domain codebook in the second and third codebook stages, respectively, as a function of characteristics of the input sound signal. The selector may also be responsive to the bit rate of the codec using the modified CELP model to select no codebook in the third stage, more specifically to bypass the third stage. In the latter case, no third codebook stage follows the second one.

As illustrated in FIG. 6, the selector may comprise a classifier 601 responsive to the input sound signal such as speech to classify each of the successive frames for example as active speech frame (or segment) or inactive speech frame (or segment). The output of the classifier 601 is used to drive a first switch 602 which determines if the second codebook stage after the adaptive codebook stage is ACELP coding 604 or transform-domain (TD) coding 605. Further, a second switch 603 also driven by the output of the classifier 601 determines if the second ACELP stage 604 is followed by a TD stage or if the second TD stage 605 is followed by an ACELP stage 607. Moreover, the classifier 601 may operate the second switch 603 in relation to an active or inactive speech frame and a bit rate of the codec using the modified CELP model, so that no further stage follows the second ACELP stage 604 or second TD stage 605.

In an illustrative example, the number of codebooks (stages) and their order in a modified CELP model are shown in Table I. As can be seen in Table I, the decision by the classifier 601 depends on the signal type (active or inactive speech frames) and on the codec bit-rate.

TABLE I

Codebooks in an example of modified CELP model (ACB stands for adaptive codebook and TDCB for transform-domain codebook)

| Codec Bit Rate | Active Speech Frames | Inactive Speech Frames |
|---|---|---|
| 16 kbit/s | ACB→ACELP | ACB→ACELP |
| 24 kbit/s | ACB→ACELP | ACB→ACELP |
| 32 kbit/s | ACB→TDCB→ACELP | ACB→ACELP→TDCB |
| 48 kbit/s | ACB→TDCB→ACELP | ACB→ACELP→TDCB |

Although examples of implementation are given herein above with reference to an ACELP model, it should be kept in mind that a CELP model other than ACELP could be used. It should also be noted that the use of DCT and AVQ are examples only; other transforms can be implemented and other methods to quantize the transform-domain coefficients can also be used.

What is claimed is:

1. A Code-Excited Linear Prediction (CELP) codebook coding device for encoding sound into first, second, and third sets of encoding parameters, comprising:

a first calculator of a first target signal for an adaptive codebook search in response to an input sound signal;

a CELP adaptive codebook stage structured to search, in response to the first target signal, an adaptive codebook to find an adaptive codebook index and an adaptive codebook gain, the adaptive codebook index and gain forming the first set of encoding parameters;

a CELP innovative codebook stage structured to search, in response to a second target signal, a CELP innovative codebook to find an innovative codebook index and an innovative codebook gain, the innovative codebook index and gain forming the second set of encoding parameters;

a transform-domain codebook stage structured to calculate, in response to a third target signal, transform-domain coefficients and a transform-domain codebook gain, the transform-domain coefficients and the transform-domain codebook gain forming the third set of encoding parameters;

a second calculator of the second target signal and a third calculator of the third target signal;

a selector of an order of the CELP innovative codebook stage and the transform-domain codebook stage as a function of at least one of (a) characteristics of the input sound signal and (b) a bit rate of a codec using the CELP codebook coding device, wherein the selector comprises switches having a first position where the CELP innovative codebook stage is first and followed by the transform-domain codebook stage and a second position where the transform-domain codebook stage is first and followed by the CELP innovative codebook stage, and wherein:

in the first position of the switches, the second calculator determines the second target signal using the first target signal and information from the CELP adaptive codebook stage and the third calculator determines the third target signal using the second target signal and information from the CELP innovative codebook stage; and in the second position of the switches, the third calculator determines the third target signal using the first target signal and information from the CELP adaptive codebook stage and the second calculator determines the second target signal using the first target signal and information from the CELP adaptive codebook stage and the transform-domain codebook stage, wherein each of the first calculator, the CELP adaptive codebook stage, the CELP innovative codebook stage, the transform-domain codebook stage, the second calculator, the third calculator, and the selector is configured to be processed by one or more processors, wherein the one or more processors is coupled to a memory.

2. A CELP codebook coding device as defined in claim 1, wherein the selector is responsive to both the characteristics of the input sound signal and a bit rate of the codec using the CELP codebook coding device to bypass a last codebook stage amongst the CELP adaptive codebook stage and the transform-domain codebook stage.

3. A CELP codebook coding device as defined in claim 1, wherein the selector comprises a classifier of the input sound signal, and the switches are controlled by the classifier to change the order of the CELP innovative codebook stage and the transform-domain codebook stage.

4. A CELP codebook coding device as defined in claim 3, wherein the classifier classifies each of successive segments of the input sound signal as active speech segment or inactive speech segment.

5. A CELP codebook coding device as defined in claim 1, wherein the transform-domain codebook stage comprises a calculator of a transform of the third target signal and a quantizer of the transform-domain coefficients from the transform calculator.

6. A CELP codebook coding device as defined in claim 5, wherein the transform is a discrete cosine transform and the quantizer is an algebraic vector quantizer.

7. A CELP codebook coding device as defined in claim 5, wherein the transform-domain codebook stage comprises a pre-emphasis filter processing the third target signal before supplying said third target signal to the transform calculator.

8. A CELP codebook coding device as defined in claim 5, wherein the transform-domain codebook stage further comprises a calculator of an inverse transform of the quantized transform-domain coefficients from the quantizer, a de-emphasis filter for processing the inverse transformed, quantized transform-domain coefficients to produce a time-domain excitation signal, a weighted synthesis filter for processing the time-domain excitation signal to produce a filtered transform-domain codebook excitation signal, and an amplifier using the transform-domain codebook gain for scaling the filtered transform-domain codebook excitation signal to produce a transform-domain codebook excitation contribution.

9. A CELP codebook coding device as defined in claim 5, wherein the adaptive codebook of the CELP adaptive codebook stage is supplied with an adaptive codebook index to produce an adaptive codebook vector, and wherein the calculator of the third target signal use the adaptive codebook vector when the transform-domain codebook follows the CELP adaptive codebook stage and the switches are in the second position.

10. A CELP codebook coding device as defined in claim 5, wherein:

the CELP adaptive codebook stage computes an adaptive codebook excitation contribution by supplying an adaptive codebook index to the adaptive codebook to produce an adaptive codebook vector, processing the adaptive codebook vector through a weighted synthesis filter to produce a filtered adaptive codebook excitation signal, and amplifying the filtered adaptive codebook excitation signal with an amplifier using an adaptive codebook gain to produce the adaptive codebook excitation contribution; and the CELP innovative codebook stage computes an innovative codebook excitation contribution by applying an innovative codebook index to the CELP innovative codebook to produce an innovative codebook vector, processing the innovative codebook vector through a weighted synthesis filter to produce a filtered innovative codebook excitation signal, and amplifying the filtered innovative codebook excitation signal with an amplifier using an innovative codebook gain to produce the innovative codebook excitation contribution.

11. A CELP codebook coding device as defined in claim 10, wherein the third calculator uses the adaptive codebook excitation contribution and the innovative codebook excitation contribution when the transform-domain codebook stage is the last codebook stage and the switches are in the first position.

12. A CELP codebook coding device as defined in claim 5, wherein the transform-domain codebook stage comprises a bit budget allocated to the quantization by the quantizer that is a sum of a fixed bit budget and a floating number of bits.

13. A CELP codebook coding device as defined in claim 12, wherein the floating number of bits in a current sub-frame comprises bits unused for the quantization in a previous sub-frame.

14. A CELP codebook coding device as defined in claim 5, wherein the transform-domain codebook stage comprises a calculator of the transform-domain codebook gain using transform-domain coefficients from the transform calculator and quantized transform-domain coefficients from the quantizer.

15. A CELP codebook coding device as defined in claim 1, wherein the transform-domain codebook stage produces a transform-domain codebook excitation contribution, and wherein the CELP innovative codebook stage uses the transform-domain codebook excitation contribution to refine the adaptive codebook gain.

16. A CELP codebook coding device as defined in claim 1, comprising a limiter of the adaptive codebook gain in the presence of inactive sound signal segments.

17. A Code-Excited Linear Prediction (CELP) codebook coding method for encoding sound into first, second and third sets of encoding parameters, comprising:

receiving a sound signal on an input from a microphone or a storage device;

calculating a first target signal for an adaptive codebook search in response to the input sound signal;

in a CELP adaptive codebook stage, searching in response to the first target signal an adaptive codebook to find an adaptive codebook index and an adaptive codebook gain, the adaptive codebook index and gain forming the first set of encoding parameters;

in a CELP innovative codebook stage, searching in response to a second target signal a CELP innovative codebook to find an innovative codebook index and an innovative codebook gain, the innovative codebook index and gain forming the second set of encoding parameters;

in a transform-domain codebook stage, calculating in response to a third target signal transform-domain coefficients and a transform-domain codebook gain, the transform-domain coefficients and the transform-domain codebook gain forming the third set of encoding parameters;

calculating the second target signal and the third target signal;

selecting an order of the CELP innovative codebook stage and the transform-domain codebook stage as a function of at least one of (a) characteristics of the input sound signal and (b) a bit rate of a codec using the CELP codebook coding method, wherein:

in a selected order where the CELP innovative codebook stage is first and followed by the transform-domain codebook stage, the second target signal is determined using the first target signal and information from the CELP adaptive codebook stage and the third target signal is determined using the second target signal and information from the CELP innovative codebook stage; and in a selected order where the transform-domain codebook stage is first and followed by the CELP innovative codebook stage, the third target signal is determined using the first target signal and information from the CELP adaptive codebook stage and the second target signal is determined using the first target signal and information from the CELP adaptive codebook stage and the transform-domain codebook stage wherein each of the receiving, calculating, searching and selecting operation is configured to be processed by one or more processors, wherein the one or more processors is coupled to a memory.

18. A CELP codebook coding method as defined in claim 17, comprising bypassing, in response to both the characteristics of the input sound signal and the bit rate of the codec using the CELP codebook coding method, a last codebook stage amongst the CELP innovative codebook stage and the transform-domain codebook stage.

19. A CELP codebook coding method as defined in claim 17, wherein the selection of the order of the CELP innovative codebook stage and the transform-domain codebook stage comprises classifying the input sound signal and changing the order of the CELP innovative codebook stage and the transform-domain codebook stage in response to said classification.

20. A CELP codebook coding method as defined in claim 19, wherein each of successive segments of the input sound signal is classified as active speech segment or inactive speech segment.

21. A CELP codebook coding method as defined in claim 17, wherein, in the transform-domain codebook stage, calculating transform-domain coefficients comprises calculating a transform of the third target signal and quantizing the transform-domain coefficients from the transform calculation.

22. A CELP codebook coding method as defined in claim 21, wherein the transform is a discrete cosine transform and the quantization of the transform-domain coefficients is an algebraic vector quantization.

23. A CELP codebook coding method as defined in claim 21, comprising processing, in the transform-domain codebook stage, the third target signal through a pre-emphasis filter before calculating the transform of said third target signal.

24. A CELP codebook coding method as defined in claim 21, comprising, in the transform-domain codebook stage, calculating an inverse transform of the quantized transform-domain coefficients, processing the inverse transformed, quantized transform-domain coefficients through a de-emphasis filter to produce a time-domain excitation signal, processing the time-domain excitation signal through a weighted synthesis filter to produce a filtered transform-domain codebook excitation signal, and amplifying the filtered transform-domain codebook excitation signal using the transform-domain codebook gain to scale the filtered transform-domain codebook excitation signal to produce a transform-domain codebook excitation contribution.

25. A CELP codebook coding method as defined in claim 21, comprising supplying the adaptive codebook of the CELP adaptive codebook stage with an adaptive codebook index to produce an adaptive codebook vector, and calculating the third target signal using the adaptive codebook vector when the transform-domain codebook stage follows the CELP adaptive codebook stage.

26. A CELP codebook coding method as defined in claim 21, comprising:

computing, in the CELP adaptive codebook stage, an adaptive codebook excitation contribution by supplying an adaptive codebook index to the adaptive codebook to produce an adaptive codebook vector, processing the adaptive codebook vector through a weighted synthesis filter to produce a filtered adaptive codebook excitation signal, and amplifying the filtered adaptive codebook excitation signal with an amplifier using an adaptive codebook gain to produce the adaptive codebook excitation contribution; and computing, in the CELP innovative codebook stage, an innovative codebook excitation contribution by applying an innovative codebook index to the CELP innovative codebook to produce an innovative codebook vector, processing the innovative codebook vector through a weighted synthesis filter to produce a filtered innovative codebook excitation signal, and amplifying the filtered innovative codebook excitation signal with an amplifier using an innovative codebook gain to produce the innovative codebook excitation contribution.

27. A CELP codebook coding method as defined in claim 26, wherein the third target signal is calculated using the adaptive codebook excitation contribution and the innovative codebook excitation contribution when the transform-domain codebook stage is the last codebook stage.

28. A CELP codebook coding method as defined in claim 21, comprising allocating, in the transform-domain codebook stage, a bit budget to the quantization of the transform-domain coefficients that is a sum of a fixed bit budget and a floating number of bits.

29. A CELP codebook coding method as defined in claim 28, wherein the floating number of bits in a current sub-frame comprises bits unused for the quantization in a previous sub-frame.

30. A CELP codebook coding method as defined in claim 21, comprising, in the transform-domain codebook stage, calculating the transform-domain codebook gain using the transform-domain coefficients and the quantized transform-domain coefficients.

31. A CELP codebook coding method as defined in claim 17, comprising producing, in the transform-domain codebook stage, a transform-domain codebook excitation contribution, and using, in the CELP innovative codebook stage, the transform-domain codebook excitation contribution to refine the adaptive codebook gain.

32. A CELP codebook coding method as defined in claim 17, comprising limiting the adaptive codebook gain in the presence of inactive sound signal segments.

* * * * *